US005804150A

United States Patent [19]

Tacke et al.

[11] Patent Number: 5,804,150

[45] Date of Patent: Sep. 8, 1998

[54] PROCESS FOR TREATING GOLD-CONTAINING SULFIDE ORES

[75] Inventors: Michael Tacke, Friedrichsdorf; Walter Pierson, Eschborn; Eberhard Stolarski, Oberursel, all of Germany

[73] Assignee: Metallgesellschaft Aktiengesellschaft, Frankfurt am Main, Germany

[21] Appl. No.: 805,409

[22] Filed: Feb. 24, 1997

[30] Foreign Application Priority Data

Mar. 9, 1996 [DE] Germany ..... 196 09 286.8

[51] Int. Cl.[6] ..... C22B 11/00; C22B 1/00; C22B 3/00

[52] U.S. Cl. ..... 423/23; 423/27; 423/29; 423/45; 423/47

[58] Field of Search ..... 423/47, 23, 27, 423/45, 29

[56] References Cited

U.S. PATENT DOCUMENTS

| | | | |
|---|---|---|---|
| 1,824,093 | 9/1931 | Meyer | 423/47 |
| 4,619,814 | 10/1986 | Salter et al. | 423/27 |
| 4,731,114 | 3/1988 | Ramadorai et al. | 423/47 |
| 5,147,617 | 9/1992 | Touro et al. | 423/27 |
| 5,147,618 | 9/1992 | Touro et al. | 423/27 |

*Primary Examiner*—Steven Bos
*Attorney, Agent, or Firm*—Herbert Dubno; Jonathan Myers

[57] ABSTRACT

The ore which contains gold and at least one of the metals silver, copper, nickel, zinc or iron is calcined at temperatures in the range from 500° to 900° C. with the addition of oxygen-containing gas, thereby producing a metal-oxide-containing solids mixture and a $SO_2$-containing exhaust gas. The $SO_2$containing exhaust gas is brought in contact with aqueous solution, thereby producing a sulfite-containing solution. The solids mixture from the calcination is cooled to temperatures in the range from 50° to 300° C. and is stirred up with the sulfite-containing solution. Metal oxides are dissolved, and a sulfate-containing solution os formed. In a first separating zone, the sulfate-containing solution is separated from the solids, and either the solids are supplied to a gold leaching or the sulfate-containing solution is subjected to a further treatment for the separation of nonferrous metals.

9 Claims, 1 Drawing Sheet

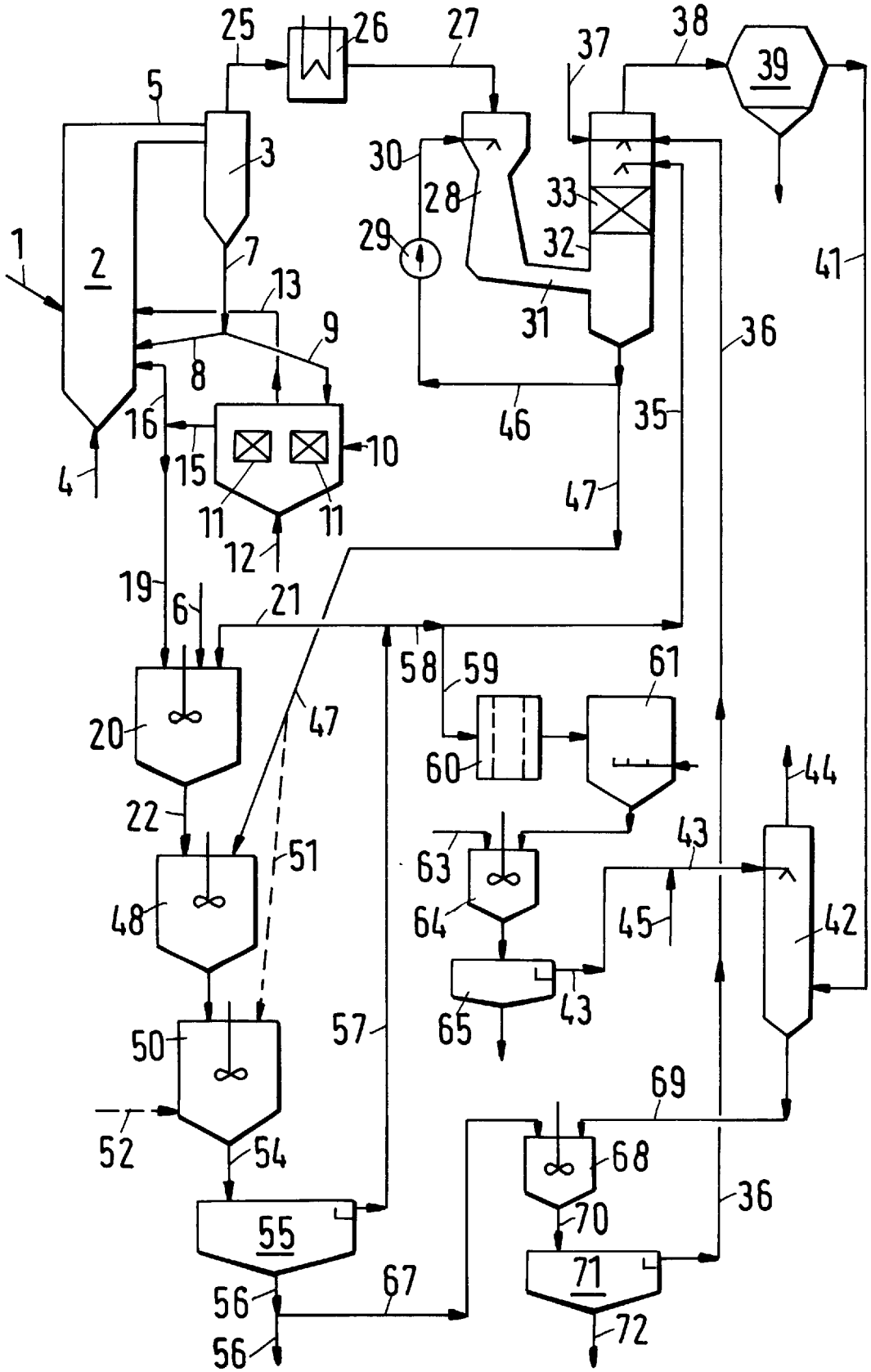
25
26
27
37
38
39
5
3
30
28
33
32
29
1
2
7
13
9
8
31
41
36
16
15
10
46
35
4
11
11
12
47
19
6
21
58
59
61
20
47
60
44
22
51
63
43
48
64
45
42
65
43
57
50
69
52
54
68
36
70
55
67
71
56
56
72

PROCESS FOR TREATING GOLD-CONTAINING SULFIDE ORES

SPECIFICATION

FIELD OF THE INVENTION

This invention relates to a process for treating a granular sulfide ore containing gold and at least one of the metals silver, copper, nickel, zinc or iron. More particularly the invention relates to a process for treating the ore through calcination at a temperature of 500° to 900° C. with the addition of a gas containing free oxygen to produce a metal oxide-containing solids mixture and an $SO_2$-containing exhaust gas.

BACKGROUND OF THE INVENTION

Processes to treat the sulfide ores are disclosed in DE-C-4122895 and DE-C-4329417. The goal of the prior art processes is to perform the calcination of the ores in an optimized way. The $SO_2$-containing exhaust gas produced is purified and no longer brought in contact with the metal-oxide-containing solids mixture produced during the calcination.

OBJECT OF THE INVENTION

The object of the invention is to utilize the $SO_2$-containing exhaust gas for the treatment of the ore and thus to improve the recovery of metals, especially of gold.

SUMMARY OF THE INVENTION

In accordance with the process of the invention, this object is achieved in that the $SO_2$-containing exhaust gas produced during the calcination is brought in contact with an aqueous solution and an aqueous sulfite-containing solution is produced. In the new process the metal oxide-containing solids mixture from the calcination is cooled to temperatures in the range of 50° to 300° C., and the cooled metal-oxide-containing solids mixture is stirred up with sulfite-containing solution, where metals of the solids mixture are dissolved and a sulfite and sulfate-containing solution is formed, that in a first separating zone the sulfite and sulfate-containing solution is separated from the solids, and either the solids are supplied to a gold recovery or the sulfite and sulfate-containing solution is supplied to a separation of non-ferrous metals. It is of course also possible to simultaneously charge the gold leaching device and the device for separating the non-ferrous metals.

In the process in accordance with the invention, metal oxides of the solids mixture coming from the calcination are dissolved as sulfites and in part also as sulfates. In accordance with a first process variant, the sulfate-containing solution, with which the cooled metal-oxide-containing solids mixture is stirred up, can be produced in a washing zone through which the $SO_2$-containing exhaust gas is passed. Another possibility is to pass the $SO_2$-containing exhaust gas through a stirring zone, in which the cooled metal-oxide-containing solids mixture is stirred up with aqueous solution. The important thing is that in all these possible processes metal sulfites and metal sulfates are produced, which go into solution. There remains a gold-containing solids mixture poor in accompanying metals, which is supplied to the recovery of gold. The gold recovery can be effected in a manner known per se, for instance by cyaniding. Due to the previously effected separation of accompanying metals, the cyanide consumption is reduced considerably in this leaching process. As a result of the preceding separation of accompanying metals, the solids mixture contains granules with a more porous structure, which are easier to leach, and the yield of gold during leaching is increased at the same time. It is furthermore advantageous that the exhaust gas supplied to the gas purification has a reduced $SO_2$ content.

One process variant consists in that from part of the sulfite and sulfate-containing solution withdrawn in the first separating zone metals are separated, the remaining solution is brought in direct contact with $SO_2$-containing exhaust gas, and a second sulfite and sulfate-containing solution is produced. This second solution is stirred up with solids separated from the first separating zone, where the content of accompanying metals in the solids is reduced. The remaining solids are supplied to the gold recovery.

BRIEF DESCRIPTION OF THE DRAWING

Embodiments of the process will now be illustrated with reference to the drawing that is FIG. 1. The drawing is a flow diagram of the process.

DETAILED DESCRIPTION OF THE DRAWING

For calcining purposes, granular gold-containing ore is supplied via line 1. The ore, which may also be an ore concentrate, usually has grain sizes in the range from 0.01 to 4 mm. Calcination is effected at temperatures in the range from 500° to 900° C. in the circulating fluidized bed in the calcinating reactor 2 with attached recirculating cyclone 3. Fluidizing gas containing free oxygen is blown in through line 4, which gas may be air, air enriched with $O_2$ or another gas rich in $O_2$. In the reactor 2, metal sulfides are converted into metal oxides, and a $SO_2$-containing exhaust gas is produced. Solids and exhaust gas are delivered through the conduit 5 to the recirculating cyclone 3, in which the solids are largely separated and in part recirculated through lines 7 and 8 to the reactor 2. Part of the hot solids flow through line 9 to a fluidized-bed cooler 10, which has cooling elements 11 for an indirect cooling. Fluidizing gas, e.g. air, is supplied through line 12 and leaves the cooler 10 in the heated condition through line 13, which likewise opens into the reactor 2. A cooled solids mixture is withdrawn from the cooler 10 through line 15 and can in part be recirculated through line 16 to the reactor 2 in a manner not represented in detail.

Cooled, metal-oxide-containing solids mixture coming from the cooler 10 is supplied through line 19 to a mixing tank 20. To this tank aqueous, sulfite and sulfate-containing solution is supplied through line 21, and sulfuric acid is supplied through line 6. The suspension formed in the tank 20 is withdrawn through line 22.

The hot $SO_2$-containing exhaust gas leaving the recirculating cyclone 3 through line 25 is first of all passed through a cooler 26. Subsequently, the exhaust gas flows through line 27 to a Venturi scrubber 28. By means of the pump 29, aqueous sulfite-containing washing solution is supplied to the scrubber 28 through line 30, which washing solution is sprayed in the scrubber 28. Exhaust gas and washing liquid flow through the conduit 31 to a washing column 32, which has a gas and liquid-permeable layer 33 of contact elements or trays.

Aqueous, sulfite-containing washing solution is supplied to the washing column 32 through line 35 and also through line 36. Fresh water is supplied via line 37. The exhaust gas treated in the column 32 flows through line 38 to a filter 39, e.g. an electrostatic precipitator or a bag filter. The exhaust gas thus dedusted and partially liberated from $SO_2$ is withdrawn via line 41. In a second washing column 42, aqueous solution from line 43 is sprayed onto the exhaust gas, which is discharged to a further purification not represented here via line 44.

At the lower end of the washing column 32 aqueous, sulfite-containing solution is withdrawn, and a partial stream is recirculated through line 46 to the Venturi scrubber 28. The remaining solution is supplied through line 47 to a stirred tank 48, where it is stirred up with the suspension from line 22. The solids separated in the electrostatic precipitator 39 may be added to the solution in line 47, which for the sake of clarity is not represented in the drawing. In the stirred tank 48, soluble sulfites and sulfates are formed from the oxides of the accompanying metals, in particular silver, copper, nickel, zinc and/or iron. In this way, these metals are at least partially removed from the gold-containing solids mixture. It is recommended to provide a second stirred tank 50 subsequent to the stirred tank 48, so as to ensure sufficient reaction times. To this second stirred tank 50 there can also be supplied a part of the aqueous sulfite-containing solution supplied via line 47, which is indicated by the broken line 52.

What is also possible, but not absolutely necessary, is to provide for the oxidation of residual sulfites to form sulfates in the stirred tank 50 through addition of $O_2$-containing gas, e.g. air.

The suspension withdrawn from the second stirred tank 50 through line 54 flows into the settling tank 55, where a gold-containing sludge rich in solids is deposited. This sludge is withdrawn via line 56 and can be supplied to a gold leaching not represented here. The low-solids phase obtained in the settling tank 55, which contains dissolved metal sulfites and metal sulfates, is withdrawn via line 57 and distributed over lines 21 and 58. A partial stream of this solution is delivered through line 59 to a known plant for recovering the metals dissolved as sulfates. In doing so, silver and copper are precipitated in a first tank 60 as scrap iron, and in a second tank 61 zinc is recovered through solvent extraction. The remaining solution is stirred up with ground limestone from line 63 in a third tank 64, so that gypsum sludge is formed. This gypsum sludge is separated from the solid phase in the settling tank 65 and can be dumped. Together with fresh water from line 45, the remaining solution is added to the column 42 as washing liquid via line 43.

If it is desired to further dissolve residual accompanying metals from the gold-containing sludge in line 56 prior to gold leaching, this sludge is supplied through line 67 to a further stirred tank 68, to which the washing liquid from column 42 is supplied through line 69. The suspension formed is delivered through line 70 to a second settling tank 71, from which the gold-containing sludge is withdrawn through line 72. This sludge in line 72 is supplied to the gold leaching not represented here. The low-solids phase, which is obtained in the second settling tank 71, is recirculated through line 36 to the washing column 32.

EXAMPLE

In a pilot plant corresponding to the drawing, the calcining reactor 2 has a height of 4 m and an inside diameter of 0.2 m. This reactor is supplied through line 1 with 20 kg/h crude ore with a specific weight of 2.52 kg/l, which contains fine grain below 5 $\mu$m in an amount of 15 wt-% and coarse grain above 1 mm in an amount of 0.1 wt-%: The main constituents of the ore are as follows:

| | |
|---|---|
| Fe | 7.8 wt-% |
| S | 9.0 wt-% |
| Zn | 0.3 wt-% |
| cu | 0.2 wt-% |
| C (organic) | 0.5 wt-% |
| inert substances and quartz | 82.2 wt-% |

The ore contains 8.5 ppm gold and 25 ppm silver. The calcining reactor 2 is operated at a temperature of 680° C., and through lines 4 and 13 an air-$O_2$ mixture is supplied to the reactor 2 in a total amount of 10 $Nm^3/h$. The air-$O_2$ mixture contains 36 vol-% $O_2$.

The calcined ore of line 19 is supplied to the mixing tank 20 in an amount of 19.0 kg/h and at a temperature of 200° C. It has the following composition:

| | |
|---|---|
| $Fe_2O_3$ | 11.8 wt-% |
| S | 0.5 wt-% |
| ZnO | 0.4 wt-% |
| CuO | 0.3 wt-% |
| C (organic) | 0.1 wt-% |
| $Al_2O_3$ | 5.5 wt-% |
| inert substances and quartz | 81.4 wt-% |

Apart from this, the ore also has the above-mentioned gold and silver content. For stirring up with the ore, 44 kg/h dilute sulfuric acid containing 1 wt-% $H_2SO_4$ are supplied to the mixing tank 20 instead of the liquids of lines 6 and 21. The liquid of line 47 is replaced by 100 l/h water with a $H_2SO_3$ content of 8 g/l, the branch line 51 is omitted. Instead, 50 l/h water, which likewise has a $H_2SO_3$ content of 8 g/l, and 250 Nl/h $O_2$ are introduced into the second stirred tank 50. The plant components with the reference numerals 58 to 72 are likewise omitted. The gold and silver-containing solids mixture is obtained in line 56 in the form of sludge, which is washed with water for removing the adhering sulfate-containing solution. The used washing water is added to the liquid via line 57. Subsequently, the washed sludge is dried and provides a solid quantity of 17 kg/h, containing 2.7 wt-% $Fe_2O_3$, 0.6 wt-% sulfur and 96.7 wt-% inert substances, and in addition, traces of organic carbon, ZnO and CuO. The liquid phase obtained in line 57 as well as the above-mentioned washing liquid together contain as sulfate in dissolved form:

| | |
|---|---|
| Fe | 1260 g/h |
| Zn | 54 g/h |
| Cu | 36 g/h |

What is claimed is:

1. A process for treating a granular sulfide ore containing gold and at least one accompanying metal other than gold, said accompanying metal being iron or a non-ferrous metal selected from the group consisting of silver, copper, nickel and zinc, which comprises the steps of:

(a) calcining the granular sulfide ore at a temperature of 500° to 900° C. with addition of gas containing free oxygen to produce a gold-containing, metal oxide-containing solids mixture and an $SO_2$-containing exhaust gas;

(b) forming an aqueous sulfite solution by contacting the $SO_2$-containing exhaust gas with an aqueous solution;

(c) cooling the gold-containing, metal oxide-containing solids mixture formed in step (a) to a temperature of 50° to 300° C. to form a cooled gold-metal oxide-containing mixture;

(d) combining the aqueous sulfite solution with the cooled gold-metal oxide-containing mixture and stirring the cooled gold-metal oxide-containing solids mixture in the aqueous sulfite solution formed in step (b) to dissolve the metal oxides in the aqueous sulfite solution to form therein the corresponding metal sulfates thereby forming an aqueous sulfite and sulfate solution; and (e) separating the solids containing gold from the aqueous sulfite and sulfate solution containing the dissolved metal sulfates.

2. The process defined in claim 1 which further comprises following the separation of the solids containing gold from the aqueous sulfite and sulfate solution containing dissolved metal sulfates according to step (e), recirculating at least a part of the aqueous solution to step (d) to form more metal sulfates.

3. The process defined in claim 1 which further comprises following the separation of the solids containing gold from the aqueous sulfite and sulfate solution containing dissolved metal sulfates according to step (e), recirculating at least a part of the aqueous sulfite and sulfate solution to step (b) to contact additional $SO_2$-containing exhaust gas.

4. The process defined in claim 1 wherein in step (d) a gas containing free oxygen is introduced into the aqueous sulfite solution to facilitate formation of the metal sulfates from the metal-oxide-containing solids.

5. The process defined in claim 1 which further comprises following the separation of the solids containing gold from the aqueous sulfite and sulfate solution containing dissolved metal sulfates according to step (e), (f) leaching the gold from the solids and recovering the gold.

6. The process defined in claim 1 which further comprises following the separation of the solids containing gold from the aqueous sulfite and sulfate solution containing dissolved metal sulfates according to step (e), (g) separating any iron and any non-ferrous metal from the aqueous sulfite and sulfate solution and recovering the nonferrous metal.

7. The process defined in claim 1 which further comprises following the separation of the solids containing gold from the aqueous sulfite and sulfate solution containing dissolved metal sulfates according to step (e), (f) leaching the gold from the solids and recovering the gold; and (g) separating any iron and any non-ferrous metal from the aqueous sulfite and sulfate solution and recovering the nonferrous metal.

8. The process defined in claim 6 which further comprises bringing into direct contact with fresh $SO_2$ gas, at least part of the aqueous sulfite and sulfate solution obtained in step (g) to produce a second aqueous sulfite and sulfate solution, stirring the second aqueous sulfite and sulfate solution with the solids containing gold obtained in step (e), thereby reducing the content of the metal other than gold in the solids, and supplying the solids to a gold recovery.

9. The process defined in claim 7 which further comprises bringing into direct contact with fresh $SO_2$ gas, at least part of the aqueous sulfite and sulfate solution obtained in step (g) to produce a second aqueous sulfite and sulfate solution, stirring the second aqueous sulfite and sulfate solution with the solids containing gold obtained in step (e), thereby reducing the content of the metal other than gold in the solids, and supplying the solids to a gold recovery.

* * * * *